US010367292B2

(12) United States Patent
Furuya et al.

(10) Patent No.: US 10,367,292 B2
(45) Date of Patent: Jul. 30, 2019

(54) SEAL MEMBER AND ELECTRICAL CONNECTOR

(71) Applicant: Tyco Electronics Japan G.K., Kanagawa (JP)

(72) Inventors: Sumiyoshi Furuya, Kanagawa (JP); Shinji Amemiya, Kanagawa (JP); Fumito Nagashima, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/939,791

(22) Filed: Mar. 29, 2018

(65) Prior Publication Data

US 2018/0287292 A1 Oct. 4, 2018

(30) Foreign Application Priority Data

Mar. 31, 2017 (JP) ..... 2017-069774

(51) Int. Cl.
*H01R 13/52* (2006.01)
*H01R 13/516* (2006.01)
(Continued)

(52) U.S. Cl.
CPC ..... *H01R 13/5202* (2013.01); *H01R 13/516* (2013.01); *H01R 13/5219* (2013.01);
(Continued)

(58) Field of Classification Search
CPC ..... H01R 13/5219; H01R 13/5202; H01R 13/5205; H01R 13/5221
(Continued)

(56) References Cited

U.S. PATENT DOCUMENTS 4,611,872 A * 9/1986 Ito ..... H01R 13/5219 439/277
4,820,181 A * 4/1989 Kuzuno ..... H01R 13/5219 439/272
(Continued)

FOREIGN PATENT DOCUMENTS

EP 1318570 A1 6/2003
EP 2688152 A1 1/2014
(Continued)

OTHER PUBLICATIONS

European Search Report, EP 18165010.2, dated Jul. 17, 2018, 10 pages.

*Primary Examiner* — Hae Moon Hyeon
*Assistant Examiner* — Peter G Leigh
(74) *Attorney, Agent, or Firm* — Barley Snyder

(57) ABSTRACT

A seal member for an electrical connector comprises a housing seal portion, a shell seal portion, and a linkage portion integrally formed with the housing seal portion and the shell seal portion and connecting the housing seal portion and the shell seal portion. The housing seal portion is configured to be pressed between a connector housing of the electrical connector and a mating housing mated to the connector housing in a mating direction. The shell seal portion is configured to be pressed between the connector housing and a shell enclosing the connector housing. The linkage portion is configured to be pressed between an end portion of the mating housing and a support portion of the connector housing in the mating direction.

18 Claims, 7 Drawing Sheets

(51) Int. Cl.
*H01R 13/6593* (2011.01)
*H01R 13/6596* (2011.01)

(52) U.S. Cl.
CPC ..... *H01R 13/5208* (2013.01); *H01R 13/6593* (2013.01); *H01R 13/6596* (2013.01); *H01R 2201/26* (2013.01)

(58) Field of Classification Search
USPC ..... 439/271
See application file for complete search history.

(56) References Cited

U.S. PATENT DOCUMENTS 5,222,909 A * 6/1993 Nomura ..... H01R 13/6582 439/271
5,389,005 A * 2/1995 Kodama ..... H01R 13/5219 439/272
5,997,349 A 12/1999 Yoshioka
6,045,383 A * 4/2000 Fujiwara ..... H01R 13/5219 439/271
6,517,368 B2 * 2/2003 Hara ..... H01R 13/521 439/271
6,521,160 B2 * 2/2003 Suzuki ..... H01R 13/5205 264/267
6,814,599 B2 * 11/2004 Sakiyama ..... H01R 13/5219 439/271
6,916,202 B2 * 7/2005 Maue ..... H01R 13/5219 439/587
6,953,357 B2 * 10/2005 Fukushima ..... H01R 13/5219 439/271
8,011,977 B2 * 9/2011 Tsuruta ..... H01R 13/6215 439/752
8,317,530 B2 * 11/2012 Sawairi ..... H01R 13/5219 439/271
8,562,377 B2 * 10/2013 Kawamura ..... H01R 9/032 439/607.44
8,992,242 B2 * 3/2015 Casses ..... H01R 13/5219 439/271
9,570,839 B2 * 2/2017 Hashimoto ..... H01R 13/5202
9,577,366 B2 * 2/2017 Ishii ..... H01R 13/5202
9,825,398 B1 * 11/2017 Uchida ..... H01R 13/5219
2002/0052140 A1 * 5/2002 Hara ..... H01R 13/521 439/587
2002/0155756 A1 * 10/2002 Yoshioka ..... H01R 13/648 439/607.01
2003/0166359 A1 * 9/2003 Maue ..... H01R 13/5219 439/589
2012/0040553 A1 2/2012 Tashiro
2012/0100753 A1 4/2012 Omae
2017/0077654 A1 * 3/2017 Yao ..... H01R 13/6594

FOREIGN PATENT DOCUMENTS

JP 200530670 A 10/2003
JP 20055135 A 1/2005
JP 2010153072 A 7/2010
JP 2015201331 A 11/2015

* cited by examiner

SEAL MEMBER AND ELECTRICAL CONNECTOR

CROSS-REFERENCE TO RELATED APPLICATION

This application claims the benefit of the filing date under 35 U.S.C. § 119(a)-(d) of Japanese Patent Application No. 2017-069974, filed on Mar. 31, 2017.

FIELD OF THE INVENTION

The present invention relates to a seal and, more particularly, to a seal for an electrical connector.

BACKGROUND

A waterproof connector, disclosed in Japanese Patent Application No. 2010-153072A, has an electric wire seal positioned in a rear end portion of a housing of the connector. The connector, for example, is a plug connector and the housing is a plug housing. The seal comes into close contact with outer peripheral portions of a plurality of cables. The electric wire seal is integrally formed with a housing seal portion which contacts an inside of a mating housing of a mating connector.

In an embodiment in which the plug connector is a shield connector, the plug connector also has a shell made of metal enclosing the plug housing and the electric wire seal positioned in the rear end portion of the plug housing is pressed by a seal cover. In order to prevent corrosion of a shield braid connected to the shell, another seal member, in addition to the electric wire seal, is positioned between the shell and the plug housing.

Thus, in order to block entry of water into a space in which a terminal of the plug connector and a terminal of the mating connector are housed, it is necessary to prevent entry of water both between the plug housing and the mating housing and to prevent entry of water between the electric wire and the plug housing. Additionally, in the case of a shield connector, in order to block water from entering the braid connected to the shell through a path between the shell and the plug housing or between the shell and the mating housing, it is necessary to prevent entry of water between the shell and the plug housing or between the shell and the mating housing. A shield connector therefore requires at least three seal members. However, since such a shield connector has a large number of components, the manufacturing and assembly costs of the sealed shield connector are high.

SUMMARY

A seal member for an electrical connector comprises a housing seal portion, a shell seal portion, and a linkage portion integrally formed with the housing seal portion and the shell seal portion and connecting the housing seal portion and the shell seal portion. The housing seal portion is configured to be pressed between a connector housing of the electrical connector and a mating housing mated to the connector housing in a mating direction. The shell seal portion is configured to be pressed between the connector housing and a shell enclosing the connector housing. The linkage portion is configured to be pressed between an end portion of the mating housing and a support portion of the connector housing in the mating direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
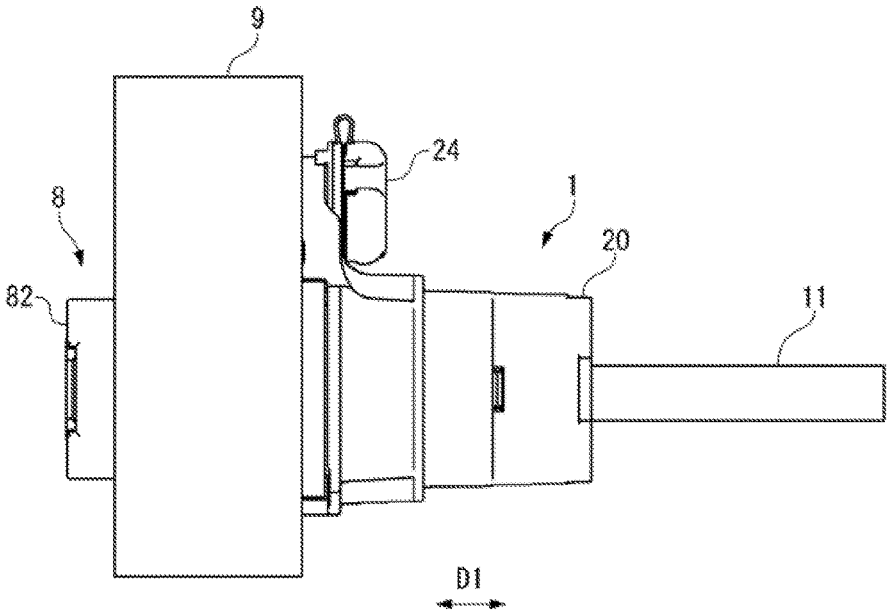
FIG. 1 is a side view of an electrical connector according to an embodiment mated with a mating connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
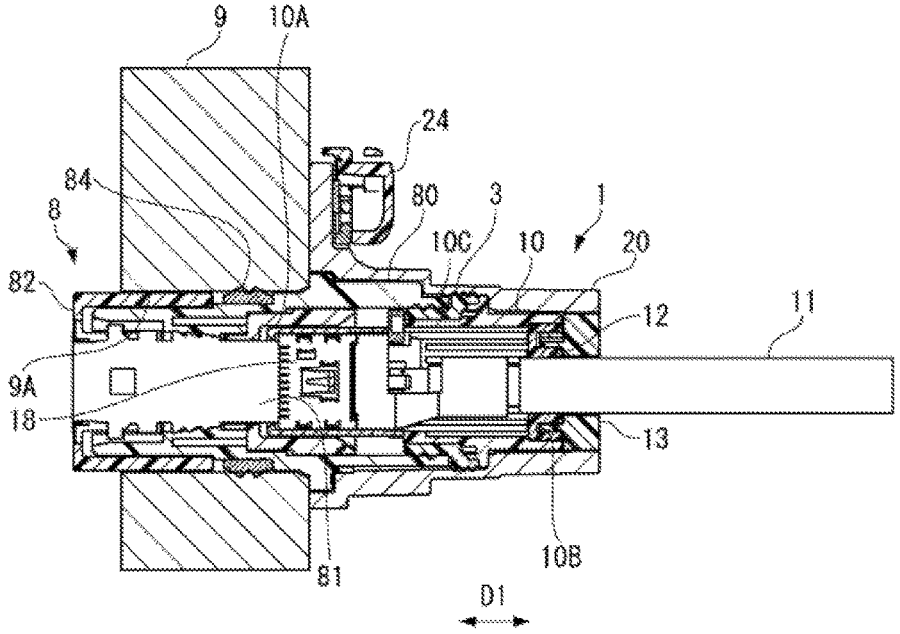
FIG. 2 is a sectional side view of the electrical connector mated with the mating connector.

An electrical connector 1 according to an embodiment is mated with a mating connector 8, as shown in FIGS. 1 and 2. Throughout the description, a side of the electrical connector 1 to be mated along a mating direction D1 with the mating connector 8 is defined as "front", and the opposite side from which an electric wire 11 is led out is defined as "rear". In an embodiment, the electrical connector 1 and the mating connector 8 are used for electrical connection of high voltage equipment, such as a PCU (Power Control Unit), installed on a vehicle. In order to reduce or eliminate the emission of electromagnetic noise outward from the equipment and/or the effect of electromagnetic noise from another equipment, the electrical connector 1 and the mating connector 8 have an electromagnetic shielding function as described in greater detail below.

The electrical connector 1, as shown in FIGS. 1 and 2, has a housing 10 from which the electric wire 11 is led out, a shell 20 for electromagnetic shielding, a seal member 3, an electric wire seal 12, and a seal cover 13. In an embodiment, the seal member 3 and the electric wire seal 12 are the two seals of the connector 1. Each of the seal member 3 and the electric wire seal 12 is formed from an elastic material such as a rubber or an elastomer.

Figure 4:
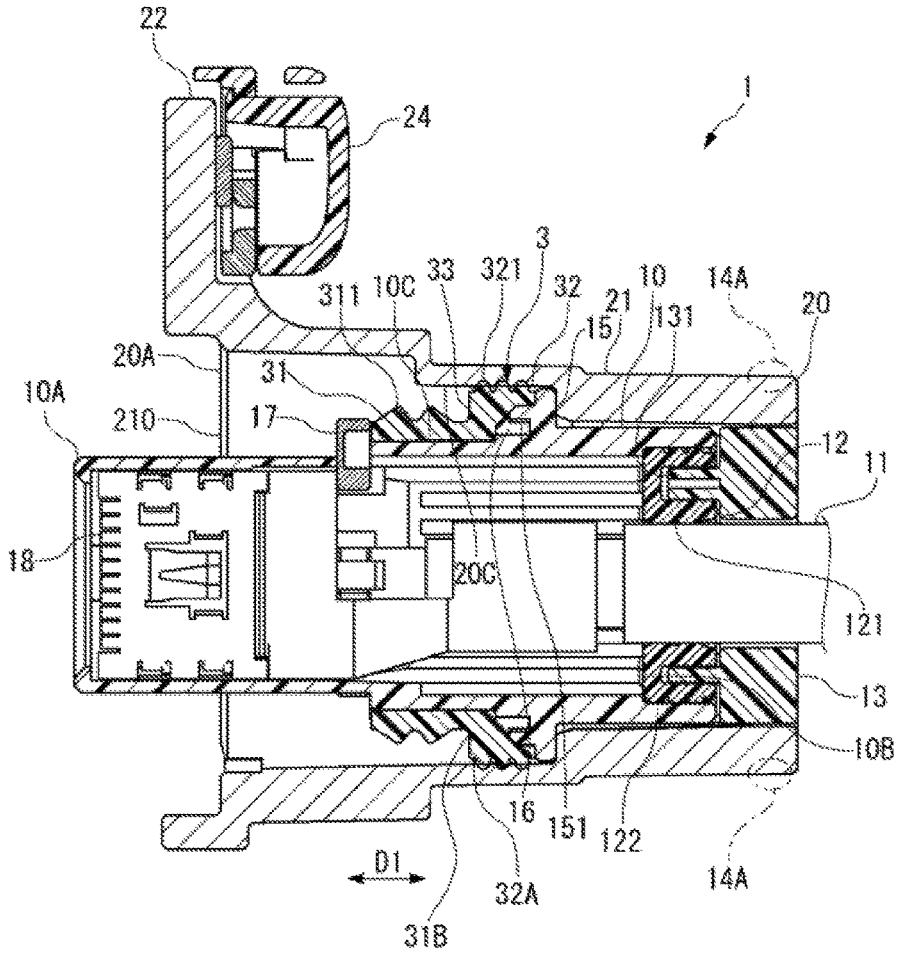
FIG. 4 is a sectional side view of the electrical connector of FIG. 2.

In an embodiment shown in FIGS. 2 and 4, the connector 1 is a two-position electrical connector having a pair of female terminals 18. In other embodiments, the connector 1 may have a single position or three or more positions. Each female terminal 18 is connected with one electric wire 11.

The electric wire 11 is covered with a braid for electromagnetic shielding. The braid includes interlaced metal wires and, in some embodiments, a reinforcing material. In an embodiment, two electric wires 11 are positioned within the braid.

The shell 20, as shown in FIGS. 1, 2, and 4, encloses portions of the housing 10 and the mating housing 8 which protrude out of a metal member 9. In an embodiment, the metal member 9 is a part of a case of a device. The shell 20 is made of a metal material in an embodiment. An end portion of the braid covering the electric wire 11 is electrically connected to an outer wall of the shell 20; in FIG. 4, a location in an outer peripheral portion of the shell 20 to which the braid is connected is denoted by a reference numeral 14A. The shell 20 is grounded to a case made of metal via the metal member 9 and provides the electromagnetic shielding function for the electrical connector 1 and the mating connector 8.

Figure 3:
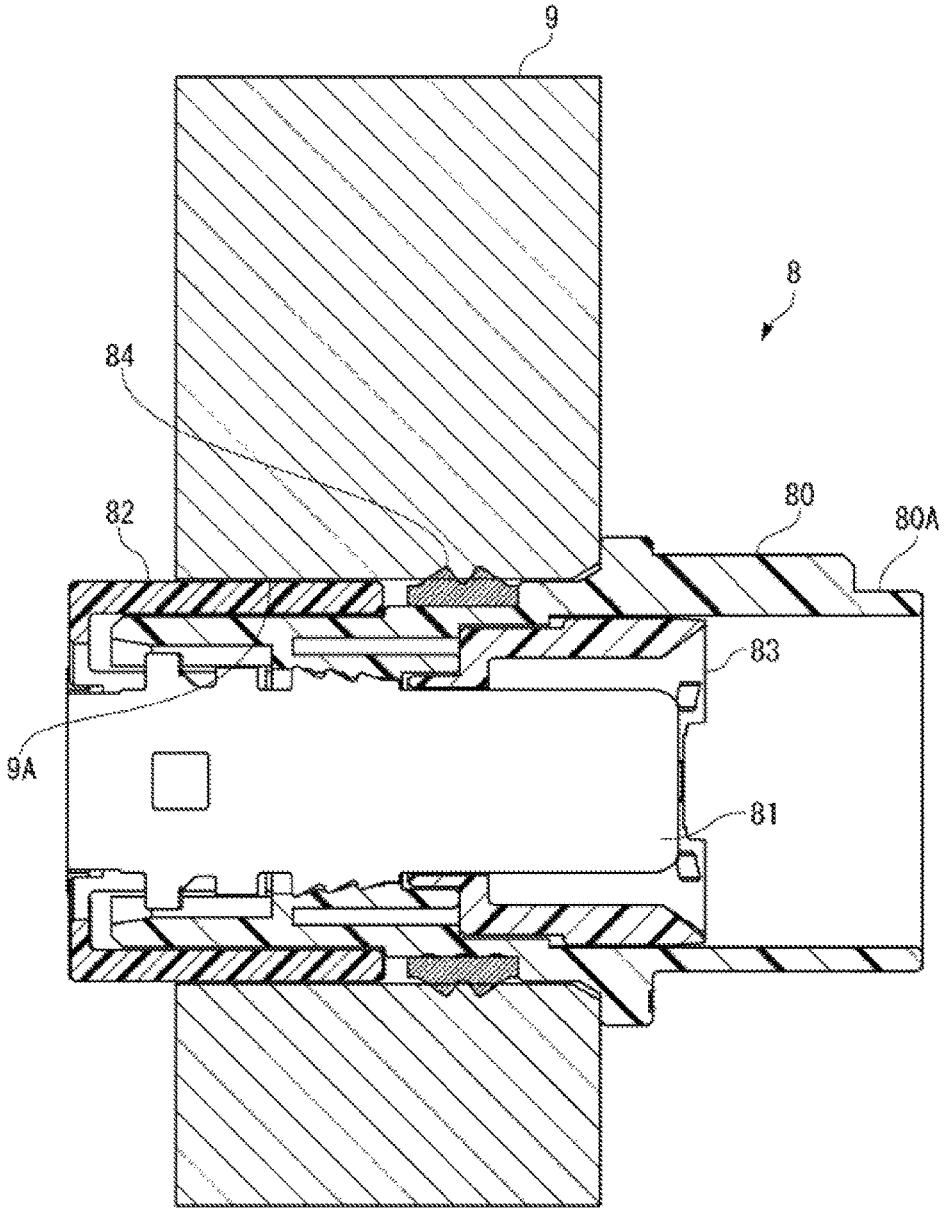
FIG. 3 is a sectional side view of the mating connector of FIG. 2.

The mating connector 8, shown in FIG. 3, has a tab-like male terminal 81 for coming into contact with the female terminal 18, a mating housing 80 retaining the male terminal 81, a rear-end-side housing 82 assembled on a rear end side of the mating housing 80, and a retainer 83 for secondarily locking the male terminal 81. The mating housing 80 is assembled with the metal member 9 in an embodiment. The mating housing 80 and the rear-end-side housing 82 are inserted into a hole 9A formed in the metal member 9 such that a part of the mating housing 80 protrudes from a surface of the metal member 9. A gap between the metal member 9 and the mating housing 80 is sealed with a ring-like seal 84.

Each component of the electrical connector 1 will now be described in greater detail.

The housing 10, as shown in FIGS. 2 and 4, retains the female terminal 18. The housing 10 is formed from an insulating resin material. When the housing 10 is mated with the mating housing 80, a front end portion 10A of the housing 10 is positioned inside the hole 9A of the metal member 9 as shown in FIG. 2. Except for the front end portion 10A, the housing 10 protrudes out of the hole 9A. The seal member 3 formed into an annular shape is mounted on an outer peripheral portion 10C of the housing 10. An accommodation portion 10B housing the electric wire seal 12 is formed in a rear end portion of the housing 10.

Figure 6:
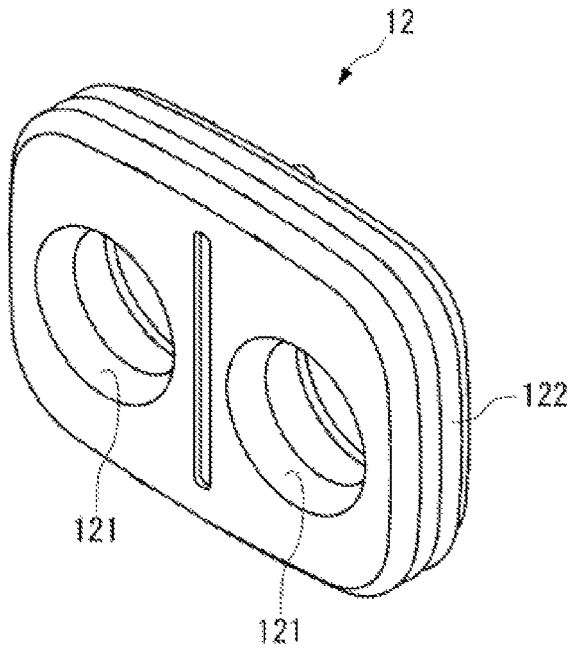
FIG. 6 is a perspective view of an electric wire seal of the electrical connector.

The electric wire seal 12, as shown in FIG. 6, has an electric-wire contact portion 121 for contacting an outer peripheral portion of the electric wire 11 led from a bottom of the accommodation portion 10B, and a housing contact portion 122 for contacting an inner peripheral portion of the accommodation portion 10B. The electric wire 11 penetrates the electric wire seal 12 and the seal cover 13 and is led out rearward. The electric-wire contact portion 121 has a plurality of annular ridges on an inner peripheral portion. The housing close-contact portion 122 has a plurality of annular ridges on an outer peripheral portion located in a radial outer end of the electric wire seal 12. The electric wire seal 12 also comes into close contact with the periphery of an opening in the bottom of the accommodation portion 10B through which the electric wire 11 penetrates. The electric wire seal 12 prevents entry of water between the electric wire 11 and the housing 10.

The seal cover 13, shown in FIG. 4, presses the electrical seal 12 to the housing 10 from the rear side. The seal cover 13 has a protrusion 131 inserted into a recess of the electric wire seal 12. When the seal cover 13 is attached to the shell 20 by a lock portion formed in the seal cover 13, the electric wire seal 12 is pressed between the seal cover 13 and the accommodation portion 10B and comes into close contact with the outer peripheral portion of each electric wire 11 and the housing 10.

The shell 20, as shown in FIGS. 1, 2, and 4, entirely encloses the housing 10 except for the front end portion 10A of the housing 10. The shell 20 and the housing 10 are attached together by a lock portion.

In an embodiment, the shell 20 is formed by die casting from a metal material, such as an aluminum alloy, a zinc alloy, or the like. The material of the shell 20 may be any material as long as it is a conductor, and any suitable metal material, whether magnetic or nonmagnetic, may be used for the shell 20. A similar metal material to the shell 20 can be also used for the material of the braid covering the electric wire 11.

The shell 20, as shown in FIG. 4, is integrally provided with a cylindrical side wall 21 enclosing the outer peripheral portion 10C of the housing 10 and an attachment portion 22 extending to a front end of the side wall 21. The mating housing 80 is inserted between the side wall 21 and the outer peripheral portion 10C of the housing 10. The front end of the side wall 21 is opened, and the front end portion 10A of the housing 10 protrudes from an opening 210 of the side wall 21. The seal cover 13 is positioned on an inner peripheral side of a rear end portion of the side wall 21.The attachment portion 22 is fastened to the metal member 9, as shown in FIG. 2, with a bolt penetrating the attachment portion 22. The head of the bolt is covered with a cover 24 made of an insulating resin material. The contact with a predetermined contact pressure between a back surface of the attachment portion 22 and a surface of the metal member 9 fastened together with the bolt ensures a required electrical connection between the shell 20 and the metal member 9 for electromagnetic shielding.

The electric wire seal 12 and the seal member 3 block entry of water into the inside of the housing 10 and the mating housing 80 in which the terminals 18 are housed. Water enters from the front end 20A of the shell 20, between the shell 20 and the mating housing 80 and housing 10.

In order to block entry of water into the housings 10, 80, it is necessary to prevent entry of water into between the housing 10 and the mating housing 80 and between the housing 10 and the electric wire 11 individually. The seal member 3 prevents entry of water between the housing 10 and the mating housing 80. The electric wire seal 12 prevents entry of water into between the housing 10 and the electric wire 11.

Figure 5:
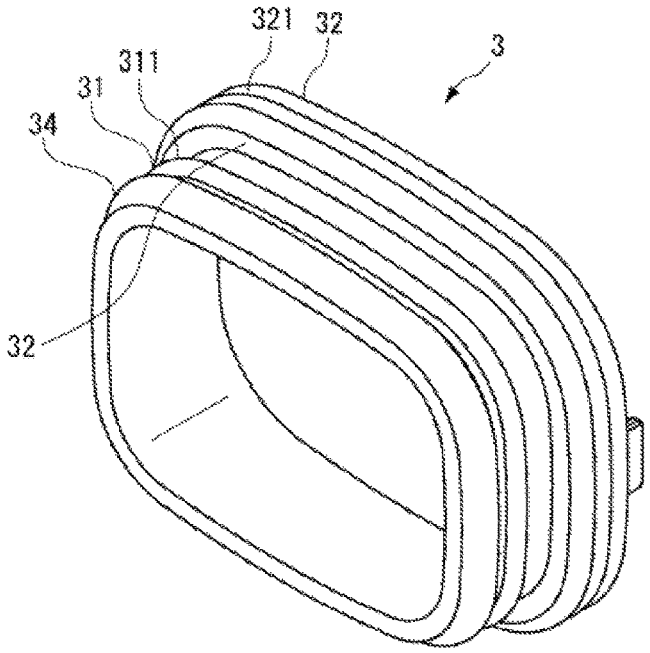
FIG. 5 is a perspective view of a seal member of the electrical connector.

It is also necessary to prevent entry of water between the shell 20 and the housing 10 or between the shell 20 and the mating housing 80 in the middle of a path from the front end 20A of the shell 20 to the location of connection 14A. As shown in FIG. 5, the seal member 3 has a shell seal portion 32. The shell seal portion 32 is pressed by the shell 20 and prevents entry of water between the shell 20 and the housing 10 covered with the shell 20. In order to prevent corrosion of the braid, specifically, corrosion of the location of connection 14A of the braid to the outer peripheral portion of the shell 20, the seal member 3 blocks water from reaching the location of connection 14A. Though the location of connection 14A is covered with a grommet accommodating a bundle cable including the electric wire 11 and the braid, water enters from the front end 20A of the shell 20 exposed from a distal end of the grommet toward the location of connection 14A of the braid.

The seal member 3 prevents entry of water at a plurality of locations. The seal member 3 is a single, integrally formed member that prevents the entry of water at a plurality of locations and also acts to suppress vibrations as described in greater detail below with reference to FIGS. 2, 4, and 5.

The seal member 3, as shown in FIG. 5, is integrally or monolithically formed in a single piece with a housing seal portion 31, the shell seal portion 32 larger in diameter than the housing seal portion 31, a linkage portion 33, and a front edge portion 34. The seal member 3 comes into contact with the housing 10, the mating housing 80, and the shell 20. The housing seal portion 31, the shell seal portion 32, and the linkage portion 33 are proximate to each other and so positioned as to be well-fitted in a slight gap between the housing 10, the mating housing 80 and the shell 20. In another embodiment, it is also conceivable that the seal that comes into contact with the shell 20 is formed integrally with the electric wire seal 12.

The housing seal portion 31, as shown in FIG. 4, is positioned around the outer peripheral portion 10C in a middle position between the front end portion 10A of the housing 10 and the rear end portion of the housing 10 in which the electric wire seal 12 is positioned. An inner peripheral face of the housing seal portion 31 is flatly formed. An outer peripheral portion of the housing seal portion 31 is formed with one or more ridges 311 extending along the periphery. The mating housing 80 is received in a gap between the ridge 311 of the housing seal portion 31 and an inner wall of the shell 20 enclosing the housing seal portion 31.

The shell seal portion 32, as shown in FIG. 4, comes into contact with the inner wall of the shell 20 since the shell seal portion 32 is made larger in diameter than a rear end portion 31B of the housing seal portion 31. An outer peripheral portion of the shell seal portion 32 is formed with one or more ridges 321 extending along the periphery.

The linkage portion 33 extends radially outward of the housing 10 from the rear end portion 31B of the housing seal portion 31 to a front end portion 32A of the shell seal portion 32 as shown in FIG. 4. That is, the linkage portion 33 links the rear end portion 31B of the housing seal portion 31 and the front end portion 32A of the shell seal portion 32 together.

The front edge portion 34, shown in FIG. 5, extends frontward from a front end of the housing seal portion 31. The front edge portion 34 is retained by a retaining member 17 of the housing 10.

The outer peripheral portion 10C of the housing 10 is formed with a support portion 15 protruding radially outward for supporting the seal member 3 as shown in FIG. 4. The support portion 15 protrudes from the outer peripheral portion 10C around the entire periphery. The seal member 3 is retained between the retaining member 17 and the support portion 15 located rearward of the retaining member 17.

The support portion 15, as shown in FIG. 4, has a protrusion 151 protruding frontward that extends around the entire periphery of the housing 10. The protrusion 151 is positioned on a backside (rear side) of the linkage portion 33. A distal end portion of the protrusion 151 of the present embodiment is inclined to the mating direction D1. The backside of the linkage portion 33 supported by the distal end portion of the protrusion 151 is also so inclined as to follow the inclination of the distal end portion of the protrusion 151. A gap 16 is formed between the protrusion 151 and the outer peripheral portion 10C. The gap 16 functions as a clearance when the linkage portion 33 elastically deforms.

To insert the seal member 3 in the housing 10, the seal member 3 is passed through the front end portion 10A of the housing 10 and the linkage portion 33 is moved to abut against the protrusion 151. The retaining member 17 prevents the seal member 3 from falling off frontward.

As shown in FIG. 4, when the housing 10, the shell 20, and the seal member 3 are assembled, the seal member 3 is positioned between the outer peripheral portion 10C of the housing 10 and the inner peripheral portion 20C of the shell 20. The shell seal portion 32 elastically deforms by being sandwiched between the inner peripheral portion 20C of the shell 20 and the outer peripheral portion 10C and the protrusion 151 of the housing 10 such that the ridge 321 of the shell seal portion 32 comes into close contact with the inner peripheral portion of the shell 20. Water is thereby prevented from entering the location of connection 14A of the braid through a path between the shell 20 and the housing 10.

Since the location of prevention of entry of water for protecting the connection 14A of the braid against corrosion is between the shell 20 and the housing 10, unlike the case that the location of prevention of entry of water is between the shell 20 and the mating housing 80, the seal member 3 offers no resistance when the mating housing 80 is inserted into the shell 20 upon mating. Sufficient insertability and mating can thereby be secured.

Figure 7:
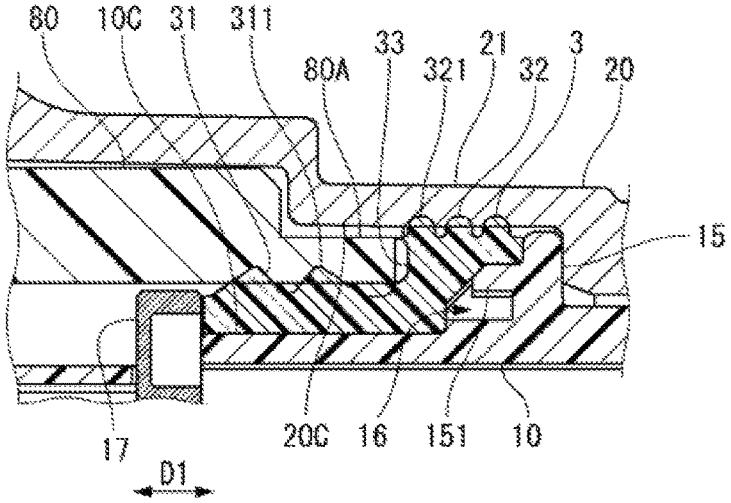
FIG. 7 is an enlarged sectional view of a portion of FIG. 2.

When the housing 10 and the mating housing 80 are mated, as shown in FIG. 7, an end portion 80A in the mating direction D1 of the mating housing 80 is inserted into a gap between the housing seal portion 31 and the side wall 21 of the shell 20. Thereupon, the housing seal portion 31 elastically deforms radially inward by being pressed by the end portion 80A. Since the housing seal portion 31 is pressed between the housing 10 and the mating housing 80, the ridge 311 comes into close contact with the end portion 80A of the mating housing 80. Thereby, water can be blocked from entering the insides of the housings 10, 80 between the housing 10 and the mating housing 80.

As shown in FIG. 7, the linkage portion 33 is sandwiched between the housing 10 and the mating housing 80 that are mated, that is, between the end portion 80A and the support portion 15 facing the end portion 80A. The linkage portion 33 elastically deforms, thereby suppressing vibration of the electrical connector 1 and the mating connector 8. The linkage portion 33 is positioned in almost an entire region of a gap between the end portion 80A and the support portion 15, and therefore a sufficient quantity of elastic deformation is secured. The gap 16 between the protrusion 151 and the outer peripheral portion 10C enables the linkage portion 33 to elastically deform smoothly.

When vibration is applied to the electrical connector 1 and the mating connector 8 by a running vehicle or the like, the linkage portion 33 elastically deforms mainly in the mating direction D1, thereby suppressing the vibration. The elastic deformation of the linkage portion 33 reduces or eliminates interference and ensures connection reliability by absorbing a relative displacement in the mating direction D1 between the electrical connector 1 and the mating connector 8.

The electrical connector 1 has a reduced number of components since the function of preventing entry of water into between the housing 10 and the mating housing 80 and the function of preventing entry of water into between the housing 10 and the shell 20 are integrated into one seal member 3. Accordingly, the manufacturing cost of the electrical connector 1, including the component cost and the assembling cost, can be reduced, as compared with the case that individual seal members are positioned between the housing 10 and the mating housing 80 and between the housing 10 and the shell 20. Further, the linkage portion 33 linking the housing seal portion 31 and the shell seal portion 32 for the integration of a plurality of portions having the function of preventing entry of water can double as a measure against vibration. That is, though not functioning to prevent entry of water, the linkage portion 33 required for the integration of the seal portions 31, 32 adds the function of suppressing vibration to the seal member 3, and therefore another member against vibration is not required and the number of components of the electrical connector 1 is further reduced.

What is claimed is:

1. A seal member for an electrical connector, comprising:

a housing seal portion configured to be pressed between a connector housing of the electrical connector and a mating housing mated to the connector housing in a mating direction and positioned around an outer peripheral portion of the connector housing;

a shell seal portion having a plurality of ridges extending around an outer peripheral portion of the shell seal portion to come into close contact with an inner peripheral portion of a metal shell, the shell seal portion further positioned around the outer peripheral portion of the housing and configured to be pressed between the connector housing and the metal shell enclosing the connector housing and separated from the connector housing; and a linkage portion integrally formed with the housing seal portion and the shell seal portion and connecting the housing seal portion and the shell seal portion, the linkage portion configured to be pressed between an end portion of the mating housing and a support portion of the connector housing in the mating direction.

2. The seal member of claim 1, wherein the shell seal portion has a diameter larger than a diameter of the housing seal portion.

3. The seal member of claim 2, wherein the housing seal portion, the shell seal portion, and the linkage portion are formed of an elastic material.

4. The seal member of claim 1, wherein the support portion of the connector housing faces the end portion of the mating housing in the mating direction.

5. The seal member of claim 4, wherein the linkage portion elastically deforms between the end portion of the mating housing and the support portion of the connector housing.

6. The seal member of claim 1, wherein the linkage portion connects a rear end portion of the housing seal portion and a front end portion of the shell seal portion.

7. The seal member of claim 1, wherein the housing seal portion has a flat inner peripheral face abutting the connector housing and a plurality of ridges extending around an outer peripheral portion of the housing seal portion.

8. The seal member of claim 7, wherein the plurality of ridges abut the mating housing in a mated position.

9. The seal member of claim 1, wherein the linkage portion has a first side extending radially outward from the connector housing in a direction perpendicular to the mating direction and a second side opposite to the first side extending at an angle with respect to the mating direction.

10. An electrical connector, comprising:

a connector housing retaining a terminal;

a metal shell enclosing the connector housing and separated from the connector housing;

a seal member simultaneously contacting a mating housing mated with the connector housing along a mating direction, the connector housing, and the metal shell, the seal member including:

a housing seal portion configured to be pressed between the connector housing and the mating housing and positioned around an outer peripheral portion of the connector housing;

a shell seal portion having a plurality of ridges extending around an outer peripheral portion of the shell seal portion to come into close contact with an inner peripheral portion of the metal shell, the shell seal portion further positioned around the outer peripheral portion of the connector housing and configured to be pressed between the connector housing and the metal shell; and a linkage portion integrally formed with the housing seal portion and the shell seal portion and connecting the housing seal portion and the shell seal portion, the linkage portion configured to be pressed between an end portion of the mating housing and a support portion of the connector housing in the mating direction.

11. The electrical connector of claim 10, wherein the shell seal portion has a diameter larger than a diameter of the housing seal portion.

12. The electrical connector of claim 11, wherein the housing seal portion, the shell seal portion, and the linkage portion are formed of an elastic material.

13. The electrical connector of claim 10, wherein the support portion of the connector housing faces the end portion of the mating housing in the mating direction.

14. The electrical connector of claim 13, wherein the support portion has a protrusion extending around an entire periphery of the connector housing and protruding in a direction counter to the mating direction.

15. The electrical connector of claim 14, wherein an end portion of the protrusion is inclined with respect to the mating direction.

16. The electrical connector of claim 15, wherein the end portion of the protrusion abuts the linkage portion.

17. The electrical connector of claim 14, wherein a gap is disposed between the protrusion and the connector housing.

18. An electrical connector, comprising:

a connector housing retaining a terminal;

a shell enclosing the connector housing;

a seal member simultaneously contacting a mating housing mated with the connector housing along a mating direction, the connector housing, and the shell, the seal member including:

a housing seal portion configured to be pressed between the connector housing and the mating housing;

a shell seal portion configured to be pressed between the connector housing and the shell; and a linkage portion integrally formed with the housing seal portion and the shell seal portion and connecting the housing seal portion and the shell seal portion, the linkage portion configured to be pressed between an end portion of the mating housing and a support portion of the connector housing faces the end portion of the mating housing in the mating direction and further having a protrusion extending around an entire periphery of the connector housing and protruding in a direction counter to the mating direction wherein an end portion of the protrusion is inclined with respect to the mating direction.

* * * * *